US005966761A

United States Patent [19]

Williams

[11] Patent Number: 5,966,761

[45] Date of Patent: Oct. 19, 1999

[54] PNEUMATIC MATTRESS

[76] Inventor: Richard D Williams, R.R. 3 Box 77, Mitchell, Ind. 47446

[21] Appl. No.: 09/070,573

[22] Filed: Apr. 30, 1998

[51] Int. Cl.[6] ..... A47C 27/08

[52] U.S. Cl. ..... 5/706; 5/656; 5/655.3; 5/420

[58] Field of Search ..... 5/420, 706, 710, 5/711, 712, 652, 655.3, 656

[56] References Cited

U.S. PATENT DOCUMENTS 1,089,652 3/1914 Lisbae ..... 5/710
2,345,421 3/1944 Perry ..... 5/706
5,412,822 5/1995 Kelly ..... 5/655.3
5,539,942 7/1996 Melou ..... 5/655.3

*Primary Examiner*—Michael F. Trettel

[57] ABSTRACT

A new pneumatic mattress for providing a lightweight inflatable resting surface. The inventive device includes a tubular perimeter member having a pair of end portions and a pair of side portions extending between the end portions of the tubular perimeter member. A number of tubular cross members are extended between the side portions of the tubular perimeter member. The lumens of the tubular cross members are in fluid communication with the lumen of the tubular perimeter member.

9 Claims, 2 Drawing Sheets

PNEUMATIC MATTRESS

BACKGROUND OF THE INVENTION

1. Field of the Invention

The present invention relates to air mattresses and more particularly pertains to a new pneumatic mattress for providing a lightweight inflatable resting surface.

2. Description of the Prior Art

The use of air mattresses is known in the prior art. More specifically, air mattresses heretofore devised and utilized are known to consist basically of familiar, expected and obvious structural configurations, notwithstanding the myriad of designs encompassed by the crowded prior art which have been developed for the fulfillment of countless objectives and requirements.

Known prior art air mattresses include U.S. Pat. No. 5,303,435; U.S. Pat. No. 5,437,068; U.S. Pat. No. 4,541,135; U.S. Pat. No. 3,959,835; U.S. Pat. No. 3,408,107; and U.S. Pat. No. 2,788,533.

While these devices fulfill their respective, particular objectives and requirements, the aforementioned patents do not disclose a new pneumatic mattress. The inventive device includes a tubular perimeter member having a pair of end portions and a pair of side portions extending between the end portions of the tubular perimeter member. A number of tubular cross members are extended between the side portions of the tubular perimeter member. The lumens of the tubular cross members are in fluid communication with the lumen of the tubular perimeter member.

In these respects, the pneumatic mattress according to the present invention substantially departs from the conventional concepts and designs of the prior art, and in so doing provides an apparatus primarily developed for the purpose of providing a lightweight inflatable resting surface.

SUMMARY OF THE INVENTION

In view of the foregoing disadvantages inherent in the known types of air mattresses now present in the prior art, the present invention provides a new pneumatic mattress construction wherein the same can be utilized for providing a lightweight inflatable resting surface.

The general purpose of the present invention, which will be described subsequently in greater detail, is to provide a new pneumatic mattress apparatus and method which has many of the advantages of the air mattresses mentioned heretofore and many novel features that result in a new pneumatic mattress which is not anticipated, rendered obvious, suggested, or even implied by any of the prior art air mattresses, either alone or in any combination thereof.

To attain this, the present invention generally comprises a tubular perimeter member having a pair of end portions and a pair of side portions extending between the end portions of the tubular perimeter member. A number of tubular cross members are extended between the side portions of the tubular perimeter member. The lumens of the tubular cross members are in fluid communication with the lumen of the tubular perimeter member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pneumatic mattress apparatus and method which has many of the advantages of the air mattresses mentioned heretofore and many novel features that result in a new pneumatic mattress which is not anticipated, rendered obvious, suggested, or even implied by any of the prior art air mattresses, either alone or in any combination thereof.

It is another object of the present invention to provide a new pneumatic mattress which may be easily and efficiently manufactured and marketed.

It is a further object of the present invention to provide a new pneumatic mattress which is of a durable and reliable construction.

An even further object of the present invention is to provide a new pneumatic mattress which is susceptible of a low cost of manufacture with regard to both materials and labor, and which accordingly is then susceptible of low prices of sale to the consuming public, thereby making such pneumatic mattress economically available to the buying public.

Still yet another object of the present invention is to provide a new pneumatic mattress which provides in the apparatuses and methods of the prior art some of the advantages thereof, while simultaneously overcoming some of the disadvantages normally associated therewith.

Still another object of the present invention is to provide a new pneumatic mattress for providing a lightweight inflatable resting surface.

Yet another object of the present invention is to provide a new pneumatic mattress which includes a tubular perimeter member having a pair of end portions and a pair of side portions extending between the end portions of the tubular perimeter member. A number of tubular cross members are extended between the side portions of the tubular perimeter member. The lumens of the tubular cross members are in fluid communication with the lumen of the tubular perimeter member.

Still yet another object of the present invention is to provide a new pneumatic mattress that is conveniently compact so that it may be easily carried by hikers, campers, and bicycle riders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
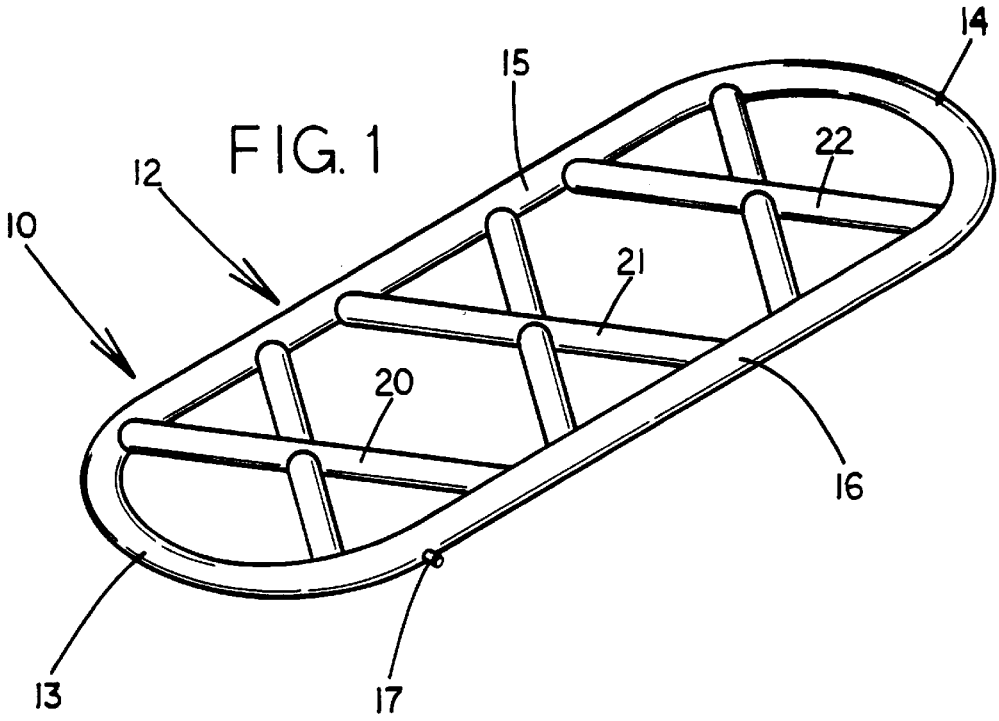
FIG. 1 is schematic perspective view of a new pneumatic mattress according to the present invention.
Figure 2:
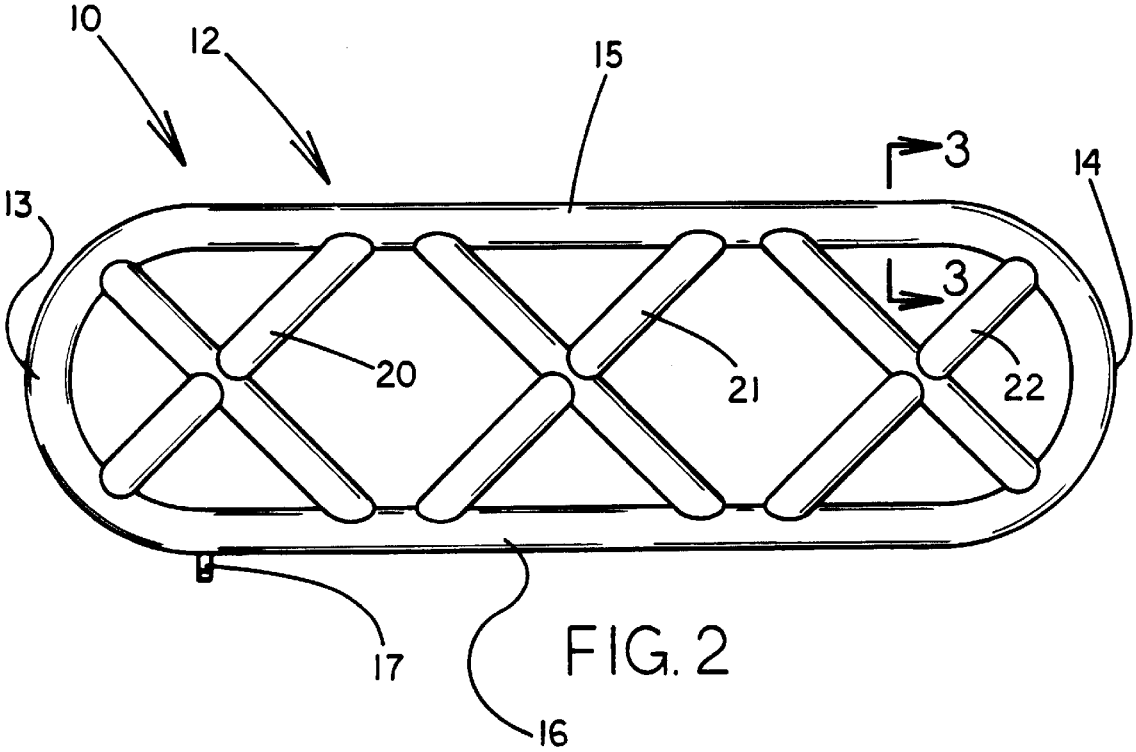
FIG. 2 is a schematic top side view of the present invention.
Figure 3:
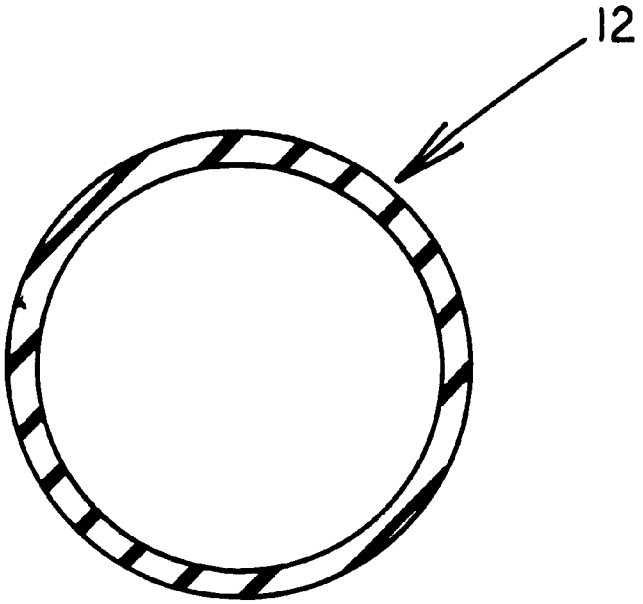
FIG. 3 is a schematic cross-sectional view of the present invention taken from line 3—3 of FIG. 2.
Figure 4:
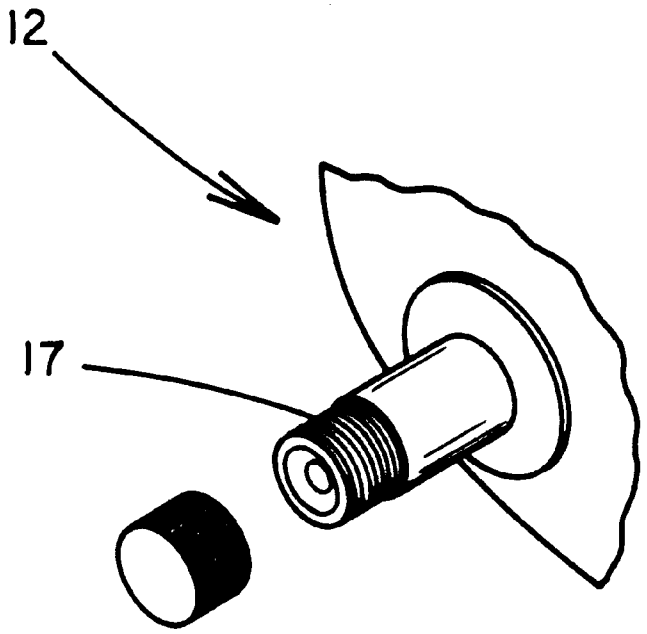
FIG. 4 is a schematic partial perspective view of the present invention of the valve.

With reference now to the drawings, and in particular to FIGS. 1 through 4 thereof, a new pneumatic mattress embodying the principles and concepts of the present invention and generally designated by the reference numeral 10 will be described.

As best illustrated in FIGS. 1 through 4, the pneumatic mattress 10 generally comprises a tubular perimeter member 12 having a pair of end portions 13,14 and a pair of side portions 15,16 extending between the end portions 13,14 of the tubular perimeter member 12. A number of tubular cross members 20,21,22 are extended between the side portions 15,16 of the tubular perimeter member 12. The lumens of the tubular cross members 20,21,22 are in fluid communication with the lumen of the tubular perimeter member 12.

Specifically, the tubular perimeter member 12 is generally oblong in shape. The tubular perimeter member 12 has a lumen, a pair of arcuate end portions 13,14 and a pair of elongate side portions 15,16 extending between the end portions 13,14. Each of the end portions 13,14 of the tubular perimeter member 12 is generally arcuate in shape while the side portions 15,16 of the tubular perimeter member 12 are elongated in shape. The tubular perimeter member 12 has a valve 17 providing an opening into the lumen of the tubular perimeter member 12 for permitting inflation of the tubular perimeter member 12. Illustratively, the valve 17 comprises a presta valve 17 such as the type found on automobile and bicycle tires. Preferably, the valve 17 is located on one of the side portions 16 of the tubular perimeter member 12.

A number of tubular cross members 20,21,22 are extended between the side portions 15,16 of the tubular perimeter member 12. Preferably, each of the tubular cross members 20,21,22 is generally X-shaped and has a lumen. The lumens of the tubular cross members 20,21,22 are in fluid communication with the lumen of the tubular perimeter member 12.

Preferably, the tubular members 12,20,21,22 are constructed from a flexible material such as rubber which is expandable when tubular members are inflated such as an inner-tube. The tubular perimeter member 12 has a length defined between the end portions 13,14 of the tubular perimeter member 12. The tubular perimeter member 12 has a width defined between the side portions 15,16 of the tubular perimeter member 12. Preferably, the width of the tubular perimeter member 12 is about one-half the length of the tubular perimeter member 12. Even more preferably, the length of the tubular perimeter member 12 is greater than about 4 feet and the width of the tubular perimeter member 12 is greater than about 2 feet. Ideally, the length of the tubular perimeter member 12 is greater than about 6 feet and less than about 8 feet while the width of the tubular perimeter member 12 is greater than about 3 feet. Preferably, the tubular members 12,20,21,22 have a diameter of between about 1 and 7 inches and ideally diameters between about 5 and 6 inches.

In use, the lumens of tubular members are inflated with air to inflate the mattress. A user may then lie on the mattress. To deflate the mattress, the valve into the lumens of the tubular members is opened to release the air inside so that the mattress may be folded or rolled into a compact shape for convenient storage and for easy transport.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pneumatic mattress, comprising:

a tubular perimeter member having a lumen, a pair of end portions and a pair of side portions extending between said end portions of said tubular perimeter member;

a number of tubular cross members, each of said tubular cross members having a lumen, each of said tubular cross members being extended between said side portions of said tubular perimeter member, said lumens of said tubular cross members being in fluid communication with said lumen of said tubular perimeter member; and wherein each of said tubular cross members is generally X-shaped.

2. The pneumatic mattress of claim 1, wherein said tubular perimeter member is generally oblong, each of said end portions of said tubular perimeter member being generally arcuate, said side portions of said tubular perimeter member being elongated.

3. The pneumatic mattress of claim 2, wherein said tubular perimeter member has a length defined between said end portions of said tubular perimeter member, and wherein said tubular perimeter member has a width defined between said side portions of said tubular perimeter member.

4. The pneumatic mattress of claim 3, wherein said width of said tubular perimeter member is about one-half said length of said tubular perimeter member.

5. The pneumatic mattress of claim 3, wherein said length of said tubular perimeter member is greater than about 4 feet, and wherein said width of said tubular perimeter member is greater than about 2 feet.

6. The pneumatic mattress of claim 1, wherein said tubular perimeter member has a valve providing an opening into said lumen of said tubular perimeter member for permitting inflation of said tubular perimeter member.

7. A pneumatic mattress, comprising:

a tubular perimeter member being generally oblong and having a lumen, a pair of arcuate end portions and a pair of elongate side portions extending between said end portions of said tubular perimeter member;

said tubular perimeter member having a valve providing an opening into said lumen of said tubular perimeter member for permitting inflation of said tubular perimeter member, said valve being located on one of said side portions of said tubular perimeter member;

said tubular perimeter member having a length defined between said end portions of said tubular perimeter member, wherein said length of said tubular perimeter member is greater than about 4 feet;

said tubular perimeter member having a width defined between said side portions of said tubular perimeter member, wherein said width of said tubular perimeter member is about one-half said length of said tubular perimeter member, wherein said width of said tubular perimeter member is greater than about 2 feet; and a number of tubular cross members, each of said tubular cross members being generally X-shaped and having a lumen, each of said tubular cross members being extended between said side portions of said tubular perimeter member, said lumens of said tubular cross members being in fluid communication with said lumen of said tubular perimeter member.

8. The pneumatic mattress of claim 2, wherein said end portions of said perimeter member have inwardly facing concavities facing one another, and wherein each of said end portions has a continuous radius of curvature between said side portions of said perimeter member.

9. A pneumatic mattress, comprising:

a tubular perimeter member having a lumen, a pair of end portions and a pair of side portions extending between said end portions of said tubular perimeter member;

said end portions of said perimeter member being arcuate in shape and having inwardly facing concavities facing one another;

each of said end portions having a continuous radius of curvature between said side portions of said perimeter member;

a number of tubular cross members, each of said tubular cross members having a lumen;

each of said tubular cross members being extended between said side portions of said tubular perimeter member, said lumens of said tubular cross members being in fluid communication with said lumen of said tubular perimeter member; and wherein each of said tubular cross members is generally X-shaped.

* * * * *